US008203461B2

(12) United States Patent
Tubel

(10) Patent No.: US 8,203,461 B2
(45) Date of Patent: Jun. 19, 2012

(54) LONG DISTANCE POWER TRANSFER COUPLER FOR WELLBORE APPLICATIONS

(76) Inventor: Paulo Tubel, The Woodlands, TX (US)

( * ) Notice: Subject to any disclaimer, the term of this patent is extended or adjusted under 35 U.S.C. 154(b) by 563 days.

(21) Appl. No.: 12/550,777

(22) Filed: Aug. 31, 2009

(65) Prior Publication Data

US 2010/0231411 A1 Sep. 16, 2010

Related U.S. Application Data

(60) Provisional application No. 61/159,589, filed on Mar. 12, 2009.

(51) Int. Cl.
*G01V 3/00* (2006.01)

(52) U.S. Cl. ..... 340/854.3; 175/61

(58) Field of Classification Search ..... 340/854.3; 175/61, 62, 45, 26, 57, 73, 95, 40; 166/250.1, 166/250.01, 65.1, 272.3, 272.6, 53, 60
See application file for complete search history.

(56) References Cited

U.S. PATENT DOCUMENTS 8,011,451 B2 * 9/2011 MacDonald ..... 175/61
* cited by examiner

*Primary Examiner* — Joseph Lauture
(74) *Attorney, Agent, or Firm* — Gary R. Maze; Berenbaum Weinshienk PC

(57) ABSTRACT

A long distance power transfer coupler for wellbore applications system uses two or more wireless modules, each wireless module comprises a self-resonant coil, to transmit energy within a wellbore. The second, and potentially subsequent, wireless modules receive radiant electromagnetic energy from a nearby neighbor which the self-resonant coil converts to usable electromagnetic energy which may be used for power, data communications, or a combination thereof. A first module may be deployed at a predetermined position in the wellbore; a cable attached to a second length of tubing; and one or more second modules attached to the tubing and coupled inductively to a resistive load. The tubing and second module or modules are deployed downhole and electromagnetic energy transmitted wirelessly between the first module and the second module. Modules may be deployed in a completion string.

22 Claims, 3 Drawing Sheets

LONG DISTANCE POWER TRANSFER COUPLER FOR WELLBORE APPLICATIONS

RELATION TO OTHER APPLICATIONS

This application claims the benefit of U.S. Provisional Application No. 61/159,589, filed on Mar. 12, 2009.

BACKGROUND OF THE INVENTION

Providing power to equipment needing power in a wellbore has meant providing long runs of cabling, self-powered equipment, or both downhole. These methods are costly and, in the case of systems using a power cable, can require extensive rework if the power cable should go bad. Further, it is not possible to provide power or communications in a main or lateral wellbore where no continuous tubing exists since there is a break in the cable.

SUMMARY

A system is disclosed that uses two or more wireless modules, at least one of the modules being connected to a power generator. Each wireless module comprises a self-resonant coil. The second, and potentially subsequent, wireless modules receive radiant electromagnetic energy from a nearby neighbor which the self-resonant coil converts to usable electromagnetic energy.

Further, the first module may be connected wirelessly to the second module to provide power, data communications, or a combination thereof.

Methods for wireless communication in a wellbore are disclosed. In one, a first module is deployed at a predetermined position in the wellbore; a cable attached to a second length of tubing; and one or more second modules attached to the tubing and coupled inductively to a resistive load. The tubing and second module or modules are deployed downhole and electromagnetic energy transmitted wirelessly between the first module and the second module.

Modules may be deployed in a completion string.

BRIEF DESCRIPTION OF THE DRAWINGS

The various drawings supplied herein are representative of one or more embodiments of the present inventions.

DETAILED DESCRIPTION OF EXEMPLARY EMBODIMENTS

As used herein, "tube" or "pipe" will be understood by one of ordinary skill in these arts to include a production pipe, an injection pipe, a portion of a tubular to be used within a wellbore or other tubular, or the like.

Figure 1:
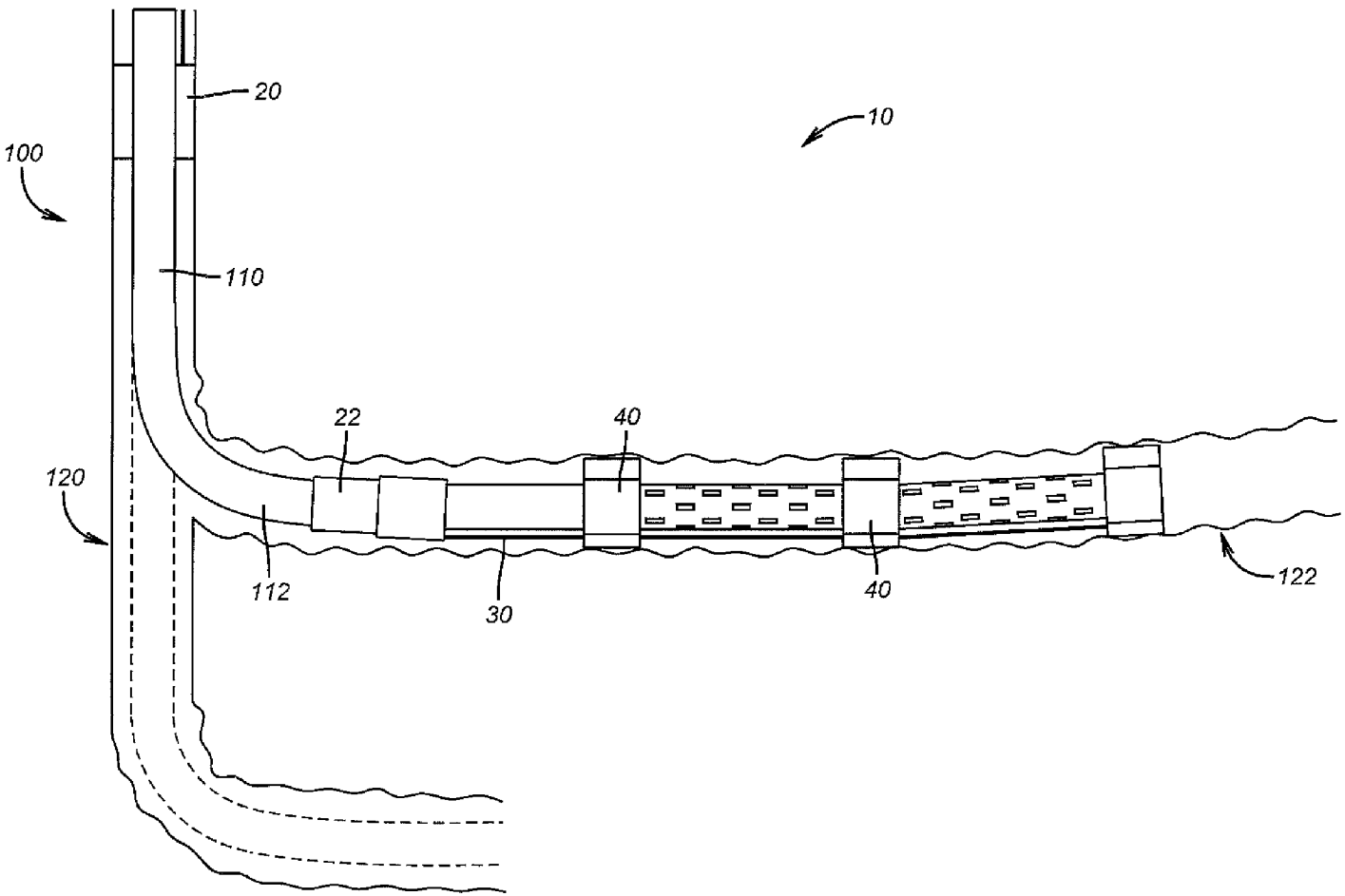
FIG. 1 is a drawing in partial perspective of a wellbore illustrating a pipeline where the use of wireless short hop power transfer provides the ability to eliminate a cable through the deviated section of the wellbore.

Referring now to FIG. 1, system 10 is dimensioned and configured to provide wireless communication of electromagnetic energy to and in wellbore 100 and its components such as to and in components in main wellbore 120 and lateral wellbore 122. As used herein, electromagnetic energy includes energy usable for power, data, or the like, or a combination thereof.

In a typical embodiment, system 10 comprises first module 20, which further comprises self-resonant coil 50 (FIG. 2); electromagnetic energy transmission cable 30 which is dimensioned and adapted to be deployed in wellbore 100; and second module 22, which further comprises its own self-resonant coil 50 and is located at a second distance from first module 20 within wellbore 100. Second module 22 is operatively in communication with electromagnetic energy transmission cable 30 such as by physical attachment.

Figure 2:
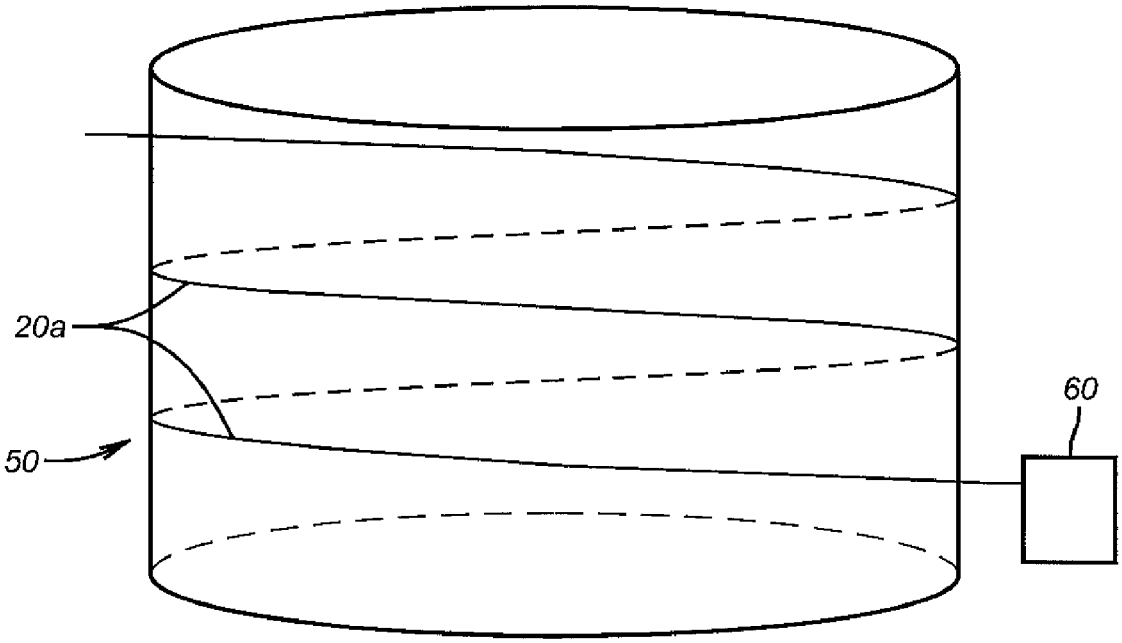
FIG. 2 is a drawing in partial perspective of a receiver.

Referring additionally to FIG. 2, first module 20 is typically located at a first distance with respect to wellbore 100, e.g. near the surface of wellbore 100, and typically comprises one or more self-resonant coils 50 which are typically coupled inductively to oscillating circuit 60. In a strongly coupled regime, first module 20 is dimensioned and configured to allow its self-resonant coil 50 to transfer non-radiative power transfer over a predetermined distance which, in a preferred embodiment, may be up to 8 times the radius of self-resonant coil 50. For example, in currently preferred embodiments, self-resonant coil 50 comprises electromagnetic energy conducting wire 20*a* having a total length L and cross-sectional radius CR wound into a helix of N turns with radius R and height H. The distance between first and second modules 20,22 (FIG. 1) may be between around 1 times the radius CR to around 8 times the radius CR.

Referring back to FIG. 1, second module 22 and its one or more self-resonant coils 50 (FIG. 2) are typically located at a second distance into wellbore 100, e.g. inside wellbore 100, and are operatively in communication with electromagnetic energy transmission cable 30 such as by physical attachment. Second module 22 typically comprises one or more self-resonant coils 50 which are dimensioned and adapted to convert electromagnetic energy from first module 20 into electrical energy, as will be understood by those of ordinary skill in these arts.

In second module 22, self-resonant coil 50 (FIG. 2) is typically coupled inductively to a resistive load, which, by way of example and not limitation, may be one or more gauges 40, e.g. a pressure and/or temperature gauge, where such gauges 40 are located deeper into wellbore 100. The inductive coupling may be wirelessly or via a cable such as cable 30 or another cable (not shown in the figures).

Figure 2A:
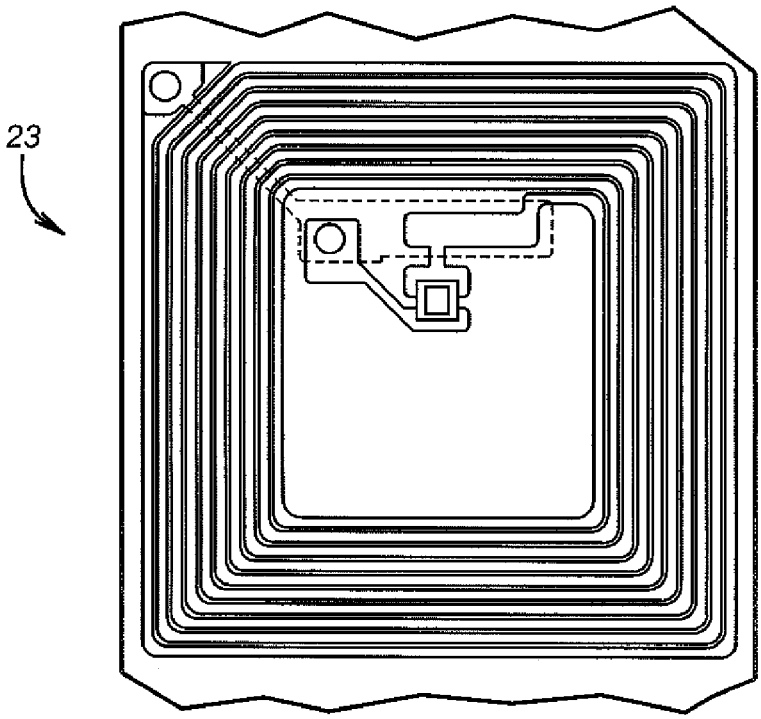
FIG. 2*a* is an illustration of an exemplary RF receiver.

Second module 22 may further comprise a pulse receiver, an RF receiver, or the like, or a combination thereof (an exemplary RF receiver is shown at 23 in FIG. 2*a*). Suitable RF receivers are manufactured by GAO RFID, 93 S. Jackson Street #57665, Seattle, Wash. 98104-2818. Second module 22 can be located at a predetermined location such as where there may not be a continuous pipe from main wellbore 100 into lateral wellbore 122, e.g. at or near the entrance of lateral wellbore 122. In certain contemplated embodiments, energy can be transferred from main wellbore 100 to lateral wellbore 122 using a plurality of first modules 20 (the plurality are not shown in the figures) and then on to second module 22 which converts the energy into electrical energy. Data may also be transmitted between one or more second modules 22 and one or more first modules 20.

Figure 3:
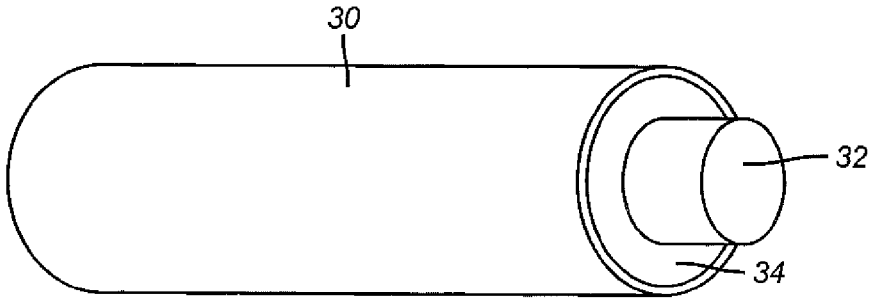
FIG. 3 is a drawing in partial perspective of a cable.

Referring additionally to FIG. 3, electromagnetic energy transmission cable 30 typically comprises center conductor 32 and ground 34. Ground 34 is most typically a metal sheath or tube used to provide an electrical ground return. Cable 30 is of a type suitable for use in wellbores 100 and/or, e.g., 122, as will be familiar to those of ordinary skill in these arts. Electromagnetic energy transmission cable 30 is dimensioned and configured to carry electrical power energy, data, or the like, or a combination thereof. Data communication utilizing electromagnetic energy transmission cable 30 typically comprises transferring data from one or more modules 22 (FIG. 1) deeper in wellbore 100 or 122 (FIG. 1) to a module closer to the surface, e.g. first module 20 (FIG. 1).

Referring back to FIG. 1, in currently contemplated embodiments, first and second modules 20,22 may be deployed inside production tubing 110, and their respective coils 50 (FIG. 2) are dimensioned and adapted to allow for power transfer inside production tubing 110, for example at spacing distances of around 2 meters. It is contemplated that first and second modules 20,22, when installed inside production tubing 110, are to be further dimensioned and configured to minimize restriction of fluids such as hydrocarbons flowing in production tubing 110, e.g. fluids would flow through or around the modules 20,22.

It is understood that a plurality of first and second modules 20,22 may exist in system 10. Further, in certain contemplated embodiments, first and second modules 20,22 are selectively insertable and retrievable from inside wellbore 100 such as to allow running logging tools in wellbore 100.

Figure 4:
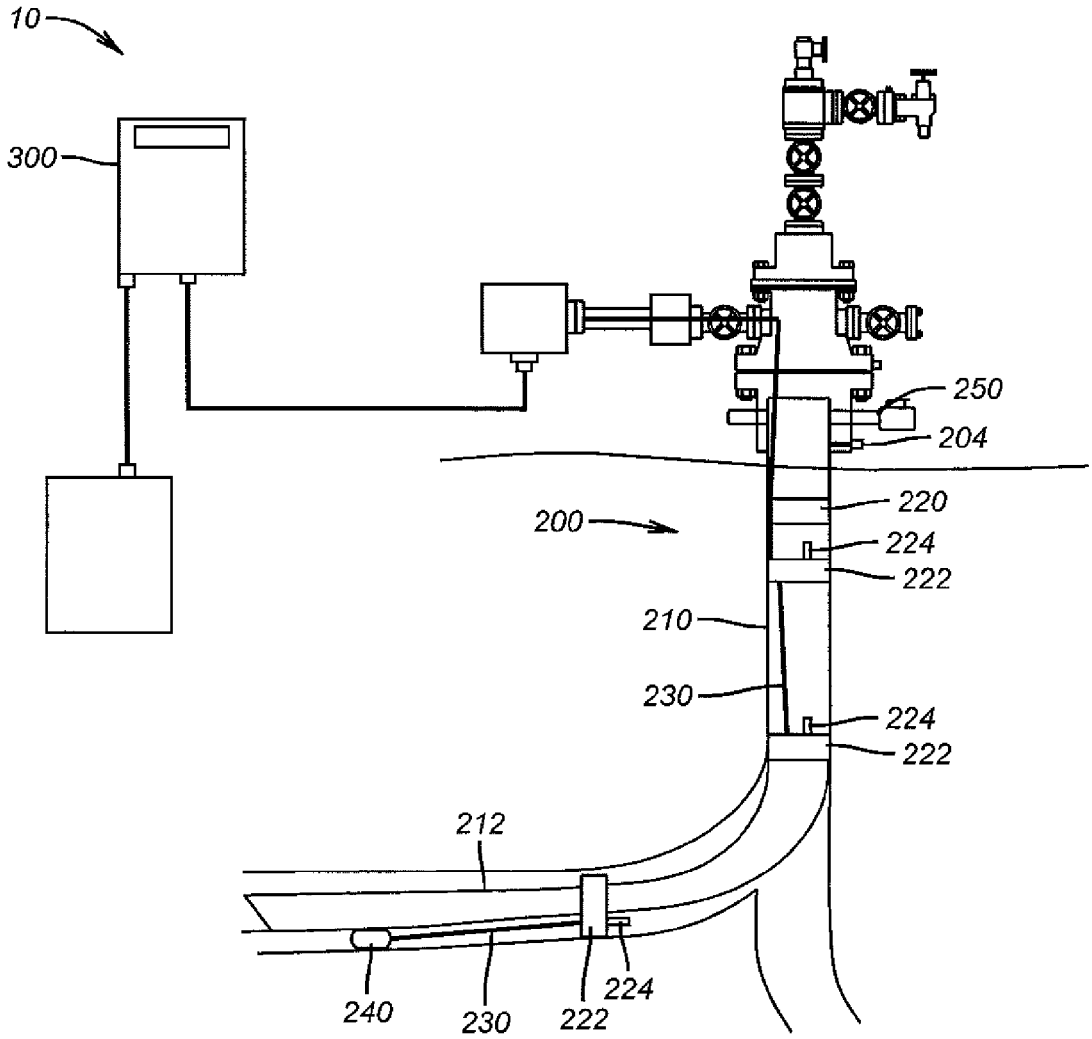
FIG. 4 is drawing in partial perspective of a representative system.

Referring now to FIG. 4, in a further embodiment, system 10 may be dimensioned and configured for wireless communications from main bore 210 to lateral bore 212 in wellbore 200. In this configuration, system 10 typically comprises surface power system 300 which is dimensioned and adapted to generate electromagnetic energy to be transmitted into wellbore 200. Such power systems are well known to those of ordinary skill in these arts. Power system 300 may further comprise data processing capabilities, e.g. a microprocessor and memory, and be used to process data received from a device deployed downhole in wellbore 200, e.g. gauge 240. First module 220 is operatively in communication with surface power system 300 such as by a wired and/or wireless connection. Cable 230 is disposed proximate the outside of tubing 210 and cable 232 is disposed proximate the outside of tubing 212 which is deployed in lateral bore 222 of wellbore 200 during the deployment of tubing 212. A plurality of second modules 222 may be present and operatively in communication with first cable 230 where at least one of the plurality of second modules 222 is deployed in lateral bore 222. A predetermined number of second modules 222, e.g. each such second module 222, may further comprise a pulse receiver, an RF receiver, or the like, or a combination thereof.

In certain configurations, first module 220 comprises coil antenna 224 deployed in main wellbore 210 of wellbore 200. Further, a predetermined number of the plurality of second modules 222, typically each such second module 222, comprises its own coil antenna 224, with each such coil antenna 224 being mounted on the outside of production tubing 210 deployed in wellbores 220, 222. In currently preferred embodiments, coil antenna 224 of second module 222 located in lateral wellbore 222 is dimensioned and configured to transmit data to first module 220 located in main wellbore 220, and lateral antenna 224 of first module 220 is dimensioned and configured to transmit data to the surface system 300.

System 10 may further comprise second cable 232 deployed in wellbore 200; wellbore device 240 deployed in wellbore 200; and distribution module 224 located proximate entrance 222*a* of lateral wellbore 222. Wellbore device 240, which may be a gauge, sensor, flow control device, or the like, or a combination thereof, is operatively coupled to second cable 230 to permit electromagnetic energy to pass between wellbore device 240 and second cable 230. Distribution module 222 is typically dimensioned and adapted to receive electromagnetic energy and route the electromagnetic energy into second cable 230.

System 10 may further comprise one or more wireless power crossover module 250 deployed in a pipe disposed outside wellhead 204 to interface with module 240 inside wellbore 200. Wireless power crossover modules 222 are wirelessly coupled to provide power into wellbore 200 as well as data communication from inside wellbore 200 to a device such as a subsea pod located proximate to wellhead 204 without the need for a wellhead penetration.

In certain embodiments, system 10 may further comprise safety valve 270 dimensioned and configured to allow electromagnetic energy to wirelessly communicate through 270 safety valve, bypassing 270 safety valve without affecting its operations.

In the operation of preferred embodiments, referring back to FIG. 1, wireless communication in wellbore 100 may be accomplished by deploying a first length of tubing 110 in wellbore 100. First module 20 is deployed at predetermined position in wellbore 100 proximate the first length of tubing 110, e.g. near the surface of wellbore 100. First module 20 is as described above.

Cable 30 is attached to a second length of tubing 112, where cable 30 is dimensioned and adapted to be deployed in wellbore 100. Cable 30 is as described above.

Second module 22 is attached to the second length of tubing 112. Second module is as described above.

Second length of tubing 112 may be deployed together with cable 30 and second module 22 at a second predetermined distance within wellbore 100, e.g. within lateral wellbore 122, and electromagnetic energy wirelessly transmitted between first module 20 and second module 22. As will be understood by those of ordinary skill in these arts, first module 20 may comprise a plurality of first modules 20, second module 22 may comprise a plurality of second modules 22, and wireless transmission of electromagnetic energy may occur between the nearest of each of the plurality of first modules 20 and the plurality of second modules 22.

In a further embodiment, module deployment in a completion string may be accomplished by deploying a lower completion string, e.g. tubing 112, such as using standard systems necessary to produce a well; deploying first module 20 at the top of an upper completion string, e.g. first length 110, where first module 20 is as described above; deploying second module 22 on lower string 112; lowering lower string 112 into or on top of a lower completion string; and interfacing first module 20 wirelessly to second module 22 to provide power, data communications, or the like, or a combination thereof. The data may be obtained from lower completion devices such as from gauges 40.

In certain embodiments, first module 20 comprises a wireless power crossover module.

The foregoing disclosure and description of the inventions are illustrative and explanatory. Various changes in the size, shape, and materials, as well as in the details of the illustrative construction and/or a illustrative method may be made without departing from the spirit of the invention.

I claim:

1. A system for wireless communication of electromagnetic energy in a wellbore, comprising:

a. a first module located at a first distance with respect to a wellbore, the first module comprising a self-resonant coil coupled to an oscillating circuit;

b. an electromagnetic energy transmission cable dimensioned and adapted to be deployed in a wellbore; and c. a second module located at a second distance with respect to the wellbore and operatively in communication with the electromagnetic energy transmission cable, the second module comprising a self-resonant coil coupled inductively to a resistive load.

2. The system of claim 1, wherein the system comprises a strongly coupled regime, wherein non-radiative power transfer occurs over distances up to 8 times the radius of the self-resonant coils.

3. The system of claim 1, wherein the second module is operatively connected to a device located in the wellbore.

4. The system of claim 3, wherein the device is at least one of a pressure gauge, a temperature gauge, a device controller, or a sensor.

5. The system of claim 1, wherein the first and second modules are deployed inside production tubing with the self-resonant coils dimensioned and adapted to allow for power transfer inside the production tubing.

6. The system of claim 5, wherein the first and second modules are installed inside the production tubing and are dimensioned and configured to minimize restriction of fluid flowing in the production tubing which flows through or around the first and second modules.

7. The system of claim 1, wherein the distance between the first and second modules is around 2 meters.

8. The system of claim 1, wherein the distance between the first and second modules is between around 1 times the radius of the self-resonant coils to around 8 times the radius of the self-resonant coils.

9. The system of claim 1, wherein the electromagnetic energy is at least one of electrical power energy or data communication.

10. The system of claim 9, further comprising a safety valve dimensioned and configured to allow the electromagnetic energy to wirelessly communicate through the safety valve, bypassing the safety valve without affecting its operations.

11. The system of claim 9, wherein data communication comprises transferring data from a module deeper in the well to a module located closer to the surface of the wellbore.

12. The system of claim 1, wherein the first and second modules are selectively insertable and retrievable from inside the well.

13. A system for wireless communications from a main bore to a lateral bore in a wellbore, comprising:

a. a surface power system dimensioned and adapted to generate electromagnetic energy to be transmitted into a wellbore;

b. a first module operatively in communication with the surface power system, the first module comprising a coil antenna deployed in first portion of the wellbore;

c. a first cable disposed proximate the outside of tubing deployed in a second portion of the wellbore during the deployment of the tubing; and d. a plurality of second modules operatively in communication with the first cable, each module comprising a coil antenna, at least one of the plurality of second modules deployed in a lateral bore, each of the plurality of second modules' coil antennae mounted on the outside of production tubing deployed in the wellbores.

14. The system of claim 13, wherein the surface power system further comprises a data processor dimensioned and configured to process data received from a device deployed downhole in the wellbore.

15. The system of claim 13, further comprising:

a. a second cable deployed in the wellbore;

b. a wellbore device deployed in the wellbore, the wellbore device operatively coupled to the second cable to permit electromagnetic energy to pass between the wellbore device and the second cable; and c. a distribution module located proximate the entrance of the lateral wellbore, the distribution module dimensioned and adapted to receive electromagnetic energy and route the electromagnetic energy into the second cable.

16. The system of claim 13, wherein:

a. a predetermined number of the coil antennae are lateral antennae;

b. a lateral antenna located in the lateral wellbore is dimensioned and configured to transmit data to a module located in the main bore; and c. a lateral antenna of a module located in the main wellbore is dimensioned and configured to transmit data to the surface system.

17. The system of claim 13, further comprising:

a. a wireless power crossover module deployed in a pipe outside the wellhead; and b. an interface operatively coupled to a module deployed inside the wellbore;

c. wherein:

i. the modules are wirelessly coupled to provide power into the wellbore; and ii. the modules are wirelessly coupled to provide communications as between a first module and a second module as well as communications from inside the well to a subsea pod at the wellhead without the need for a wellhead penetration.

18. The system of claim 13, wherein the second module comprises at least one of a pulse receiver or an RF receiver.

19. A method for wireless communication in a wellbore, comprising:

a. deploying a first length of tubing in a wellbore, a first predetermined portion of the first length of wellbore located proximate a surface point of the wellbore;

b. deploying a first module at a predetermined position in the wellbore proximate the first length of tubing, the first module comprising self-resonant coil coupled to an oscillating circuit;

c. attaching a cable to a second length of tubing, the cable dimensioned and adapted to be deployed in a wellbore and conduct electromagnetic energy;

d. attaching a second module to the second length of tubing, the second module comprising a self-resonant coil, the second self-resonant coil operatively in communication with the cable and coupled to a resistive load;

e. deploying the second length of tubing with the cable and second module at a second predetermined distance within the wellbore; and f. wirelessly transmitting electromagnetic energy between the first module and the second module.

20. The method of claim 19, wherein:

a. the first module comprises a plurality of first or second modules; and b. wireless transmission of electromagnetic energy occurs between the closest ones of the plurality of modules.

21. A method for module deployment in a completion string, comprising:

a. deploying a lower completion string;

b. deploying a first module at the top of an upper completion string, the first module further comprising a set of receivers to pick up energy from the first module;

c. deploying a second module on a lower string;

d. lowering the lower string on top of the lower completion string; and e. interfacing the first module wirelessly to the second module to provide at least one of power or data communications.

22. The method of claim 21, wherein the first module is a wireless power crossover module.

* * * * *